United States Patent [19]

Janis

[11] Patent Number: 4,514,932

[45] Date of Patent: May 7, 1985

[54] SECURITY SYSTEM WINDOW GUARD APPARATUS AND ANCHOR ASSEMBLY THEREFOR

[76] Inventor: James Janis, 4104 N. Reno, Tucson, Ariz. 85705

[21] Appl. No.: 430,402

[22] Filed: Sep. 30, 1982

[51] Int. Cl.[3] ..... E06B 9/00

[52] U.S. Cl. ..... 49/50; 49/51; 52/106

[58] Field of Search ..... 49/51, 50, 61, 63; 52/106, 208, 727, 27, 37, 507, 514; 182/229

[56] References Cited

U.S. PATENT DOCUMENTS

| | | | |
|---|---|---|---|
| 2,103,130 | 12/1937 | Windle | 52/106 X |
| 2,668,729 | 2/1954 | Watters | 49/50 X |
| 3,052,932 | 9/1962 | Poole | 49/61 X |
| 3,763,615 | 10/1973 | Yamazaki | 49/50 X |
| 3,794,365 | 2/1974 | Richberg | 292/62 |
| 3,998,294 | 12/1976 | Moeller | 182/229 |

*Primary Examiner*—Philip C. Kannan

*Attorney, Agent, or Firm*—Harry M. Weiss; William W. Holloway

[57] ABSTRACT

A window guard method and apparatus for a mobile home, which method and apparatus employ wall and foundation anchors, as well as cable-reinforced structural members, to prevent unauthorized entry while also providing wind-bracing for the mobile home.

19 Claims, 5 Drawing Figures

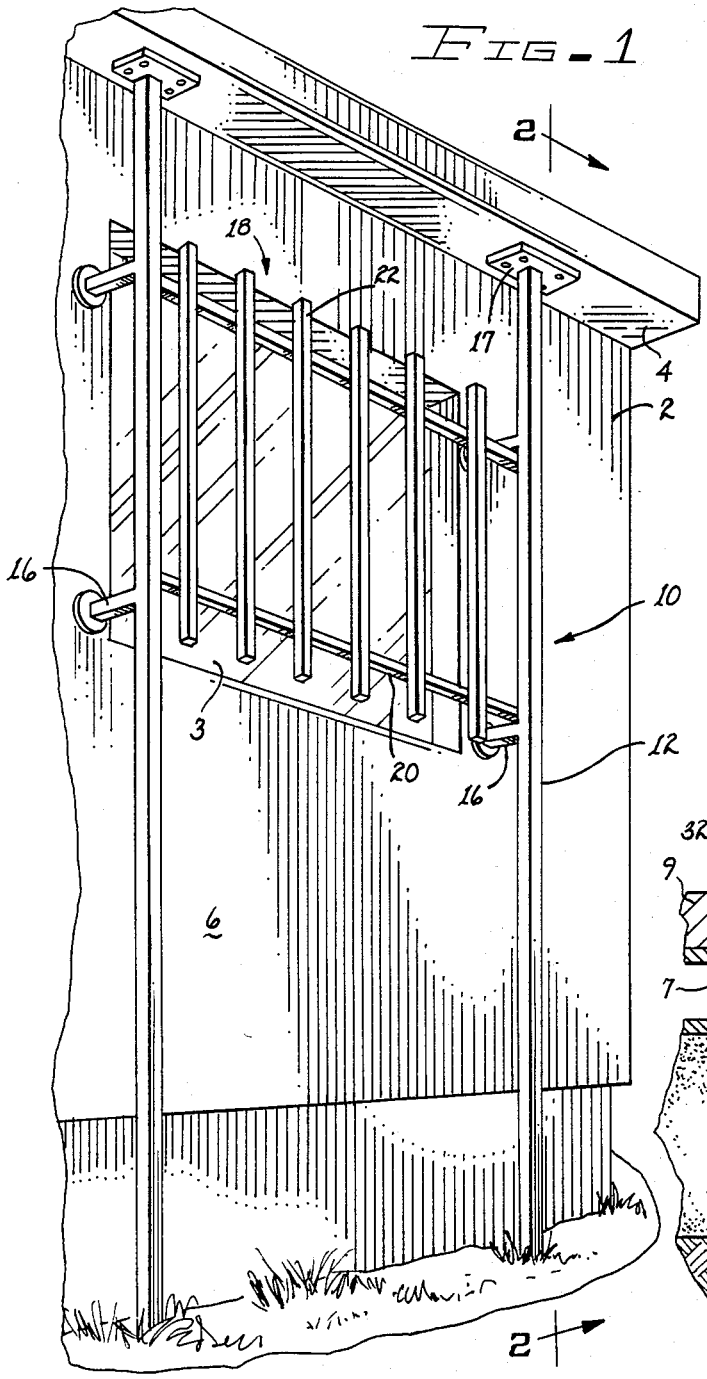
FIG. 1
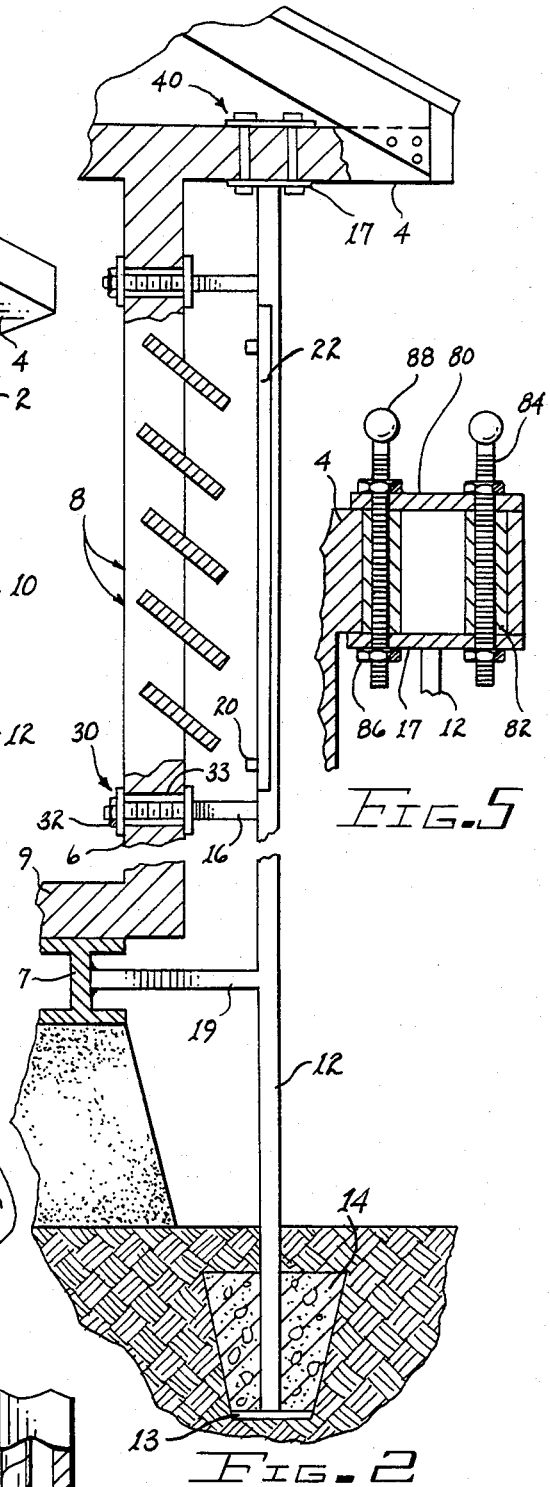
FIG. 2
FIG. 5
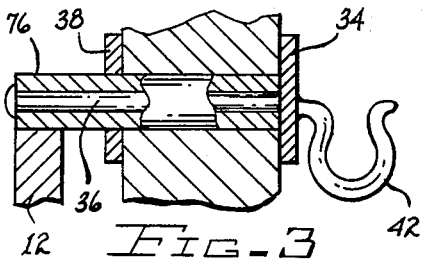
FIG. 3
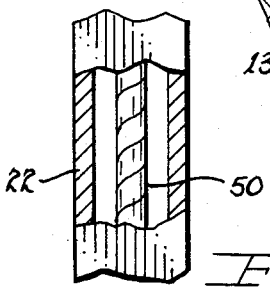
FIG. 4

SECURITY SYSTEM WINDOW GUARD APPARATUS AND ANCHOR ASSEMBLY THEREFOR

BACKGROUND OF INVENTION

1. Field of the Invention

This invention relates to a security system for securing windows against entry and, more particularly, relates to a window-opening guard that does not interfere with the normal opening and closing action of an operable window mechanism.

2. Description of the Prior Art

In the past, home security was a serious concern of all. To prevent intruders from gaining entry through the windows of a home, metal bars were often solidly anchored to the adjoining structure of the home. The bars prevented unauthorized entry, without interfering with the opening and closing functions of the window. Particularly in the case of multiple shutter-type windows, as commonly sold under the trademark "Jalousie", this required that the bar structure be spaced away from the structure of the home.

However, a problem existed: the structure of mobile homes, and similar manufactured structures, was generally somewhat lighter than the structure of conventional wood or masonry constructed buildings or houses. Thus, it was often difficult or impossible to securely anchor a typical bar-structure over the window of a mobile home.

A need continued to exist for an easily installed window guard structure, compatible with use on a mobile home.

BRIEF DESCRIPTION OF THE DRAWINGS

FIG. 1 is a perspective-elevational view of the window guard security system of the present invention;

FIG. 2 is a sectional view taken along line 2—2 of FIG. 1;

FIG. 3 is an enlarged sectional view of an alternate wall-connection for the security system of FIG. 1;

FIG. 4 is a partially sectioned view of one of the structural members of the security system of FIG. 1; and FIG. 5 is a sectional elevational view of an alternate soffit-plate connection of the present invention.

SUMMARY OF THE INVENTION

In accord with the broadest aspect of the invention, it is an object to provide a window guard for a mobile home.

It is another object to provide a secure anchoring mechanism to connect a window guard to a mobile home.

It is a further object to provide a reinforced beam-and-column structure for a window guard.

It is an object to simultaneously provide a wind bracing for a mobile home.

In accord with one embodiment of this invention, an anchor for a window guard for a mobile home is disclosed, comprising: inner plate means having an inner plate disposed to contact an inner wall of the mobile home for distributing over the wall an outwardly directed axial load; outer plate means having an outer plate disposed to contact an outer wall of the mobile home for distributing over the wall an inwardly directed axial load; connector means for sandwiching the wall between the inner plate and the outer plate; and column means for rigidly connecting the window guard to the outer plate so that the window guard is fixedly positioned with respect to the wall.

In accord with another embodiment of this invention, a window guard is disclosed, comprising: means having a plurality of tubes connected into a grid positioned adjacent the window for limiting access through the window; and cable means having a cable passing through the tubes for resisting the severing of the grid.

In accord with a further embodiment of this invention, a method for reinforcing a window guard is disclosed, comprising the steps of: fabricating the guard from tubular material; and encasing a radially movable cable within the tubular material so that the guard is extremely difficult to cut.

The foregoing and other objects, features and advantages of this invention will be apparent from the following, more particular, description of the preferred embodiments of the invention, as illustrated in the accompanying drawings.

DETAILED DESCRIPTION OF THE DRAWINGS

In FIG. 1, an improved security system for a mobile home 2 is shown generally by reference number 10. The security system 10 mounts or is installed outside of the mobile home 2, to prevent entry through a window 3. Columns 12 are anchored to a foundation 14, which is shown in FIG. 2. The columns 12 extend upward to the roof-overhang 4.

The respective columns 12 flank the window 3. A number of wall-spacers 16 may connect, and space, the vertical columns or supports 12 from an outside vertical wall 6 of the mobile home. A soffit-plate 17 is secured to the overhang 4 of the roof, as subsequently explained and operably coupled to the top end portion of the vertical column or support 12.

A grate, as shown generally by reference number 18, overlies the window 3, and is connected directly to the columns 12. The grate 18 is formed from horizontal beams, bars or members 20 and relatively closely spaced vertical instrusion beams, members or bars 22. The columns 12, the wall-spacers 16, the beams 20 and the intrusion bars 22 are all fastened together in a secure manner, as by welding or the like.

FIG. 2 is a partially sectioned elevational view taken along line 2—2 of FIG. 1. The column 12, preferably an elongated substantially hollow tube, pipe or similar vertical member is shown connected to a baseplate 13, which underlies the concrete foundation 14. The column 12 is therefore encased, cemented or otherwise secured within the foundation 14. The foundation 14 has an enlarged upper end, and is buried at a given depth in the earth sufficient to resist any attempted displacement of the security system 10 by burglars, intruders, vandals or the like.

The base or bottom 9 of the mobile home 2 rests or is operably disposed upon frame support beams 7. The column 12 is further secured in place by frame-spacers 19, which may be connected, preferably by welding, to both the column 12 and to the mobile home frame beam 7. Clamps or similar fastening devices, as shown generally by reference number 30, pass through the wall 6 and connect the space-bars 16 to the mobile home 4 by sandwiching the wall between load-distributing inner 38 and outer plates 38, 34, respectively, to avoid wall collapse, tearing, or similar damage and the like.

Threaded fasteners 32 can be used to assemble the clamps 30, and thereby secure the spacer bars 16 and the columns 12 in place with respect to the wall 6 although any similar fastening means known in the art could also be used. A spacer sleeve 33 prevents a destructive compression of the wall 6. In the alternative, welded connections as shown in FIG. 3 can be used to effect the connection between the respective portions of the clamp 30. A bolted clamp connection 40 secures the soffit plate 17 to the overhang 4 of the roof.

In combination, the wall-spacers 16, the frame-spacers 19 and the soffit-plate 17 position the columns 12, the beams 20 and the bars 22 at a sufficient distance from the mobile home 2 so as to allow full operation for even "Jalousie" type windows, as shown generally by reference number 8 without leaving sufficient room or space for an intruder, burglar, vandal or the like to squeeze or slip in to gain access to the house through the guarded window.

In FIG. 3, an alternate, permanent-type connection for the wall-spacers 16 is shown. The alternate connection employs an interior plate 34, rigidly connected by, for example, welding to a rod 36. An exterior plate 38 is rigidly attached to a tublar housing 76. The tubular housing 76 passes through the wall 6 at either or both positions adjacent to the top and bottom of the window. The outer end of the tubular housing 76 extends away from the wall 6, and is in turn rigidly connected to the column 12. The alternate connection is assembled by drilling a hole through the wall 6 of the mobile home 2 and passing the tublar housing 76 from the outside of the mobile home 2 through the freshly drilled hole until the exterior plate 38 rests flush upon the external face of the wall 6. The rod 36 is then inserted from the interior of the mobile home 2, through the tubular housing 76, until the interior plate 34 rests flush against the inner face of the wall 6. By then plug-welding the outer end of the rod 36 to the outer end of the tubular housing 76, a permanent installation of the column 12 can be effected.

A particularly advantageous aspect of the alternate connection is the provision of a hanger 42 on the inner face of the interior plate 34, which is useful as a permanent load-supporting hanger. Since it is positioned adjacent the window 3, the hanger 42 is particularly suited to supporting a curtain rod or the like (not shown).

In FIG. 4, a partially sectioned portion of one of the external structural members of the security system 10 is shown. The structural members 12, 16, 19, 20 and 22 are each perferably hollow or tubular members, with a cable 50 running therethrough. The cable 50 is anchored to the corresponding structural member in a known manner, such as with clamps or swaged fittings located at the respective ends of the cable 50. The cable 50 is smaller in diameter than the opening within the tubular members, and thereby is free to shift within the structural member and correspondingly present great difficulty to anyone trying to cut through the structural member 12, 16, 19, 20 or 22 with, for example, a hacksaw. In addition, the cable 50 can be fabricated from stainless steel, to provide a substantial resistance to being cut with a conventional oxy-acetylene torch lock or bolt cutters, hack saws, or the like.

FIG. 5 is a sectional elevational view of an alternate configuration for the connection 40 to the overhang 4, particularly adapted to a situation where the overhang 4 actually forms the roof of the mobile home 2. In the alternate configuration, the overhang 4 is flanked below by the soffit plate 17, while an upper plate 80 adjoins the upper surface of the overhang 4.

Sleeves 82 separate the plates 17, 80, while elongated bolts 84 and corresponding nuts 86 compress the plates 17, 80 against the sleeves 82 within the overhang 4. The upper reaches of the bolts 84 are elongated and define retaining heads 8, to thereby provide cable-anchorage for tying the mobile home 2 down against overturning due to high winds.

The security system 10 is used by first excavating, digging, or boring an opening to receive the column baseplate 13, and then placing an appropriately dimensioned column-and-baseplate assembly in the excavation. The frame-spacers 19 are welded to the mobile home frame 7, and the clamps 30 are installed, as explained above, to secure the system 10 to the wall 6 of the mobile home 2. The soffit-plate 17 is connected by the corresponding clamp 40 to the roof overhang 4. In this manner, an intrusion-prevention system 10 can be easily installed on a mobile home 2.

In addition to providing a limitation on un-authorized entry into the mobile home 2, while still allowing normal operation of the windows of the mobile home, the security system can provide solid and stable supports for interior hangings, such as window-curtains, while also providing wind-bracing and anchoring for the mobile home 2.

While the invention has been particularly described and shown in reference to the preferred embodiments thereof, it will be understood and appreciated by those skilled in the art that various changes in form and detail, as well as omissions, may be made therein without deparating from the spirit and scope of the invention.

I claim:

1. An anchor assembly for a window guard for a mobile home, comprising, in combination:

inner plate means having an inner plate operably disposed for contacting an inner wall of said mobile home for distributing over said wall an outwardly directed axial load;

outer plate means having an outer plate operatively disposed for contacting an outer wall of said mobile home for distributing over said wall an inwardly directed axial load;

connector means for sandwiching said wall between said inner plate and said outer plate, said connector means being removable only from inside said mobile home; and column means operably coupled to said outer plate means and to said window guard for rigidly connecting said window guard to said outer plate so that said window guard is fixedly positioned to be spaced outwardly from said wall a predetermined fixed and invariable distance therefrom so as to enable a multiple shutter-type window to be freely opened and closed from within the mobile home and to prevent the window guard from being positioned further away from said outer wall so as to enable an intruder, burgular, vandal or the like to squeeze between the window guard and use the window being guarded to gain access to the mobile home, said column means including spacer means connected to said column means and said outer plate means for keeping said column means at a fixed distance from said outer plate means.

2. The anchor assembly for a window guard of claim 1 wherein said inner plate includes a hook-shaped hanger means operatively mounted on the interior thereof for supporting a drapery and the like.

3. An anchor assembly for a window guard for a mobile home, comprising, in combination:

inner plate means having an inner plate operably disposed for contacting an inner wall of said mobile home for distributing over said wall an outwardly directed axial load;

outer plate means having an outer plate operably disposed for contacting an outer wall of said mobile home for distributing over said wall an inwardly directed axial load;

connector means for sandwiching said wall between said inner plate and said outer plate, said connector means being removable only from inside said mobile home;

column means operably coupled to said outer plate means for rigidly fixedly connecting said window guard to said outer plate so that said window guard is fixedly positioned over and spaced outwardly from said window a predetermined fixed and invariable distance to prevent the window guard from being positioned further from said outer wall so as to enable an intruder, burglar, vandal and the like to squeeze between the window guard and the outer wall to gain entrance through the protected window;

said connector means further including:

a sleeve means operatively, fixedly coupled to said outer plate and operably disposed for passing inwardly through said wall;

a rod means operatively, fixedly coupled to said inner plate and operably disposed for passing outwardly through said sleeve means; and means for operably fixedly securing said rod means and said sleeve means proximate the outer end portion of said sleeve means.

4. The window guard anchor assembly of claim 3 wherein said inner plate includes a hook-like hanger means fixedly secured thereto and operatively disposed within the interior of said mobile home for supporting draperies and the like.

5. The window guard anchor assembly of claim 3 wherein said mobile home further includes a foundation and means for supporting the foundation above the ground, said column means further including means for fixedly securing said vertical support members to said foundation-supporting means to further insure that said vertical support members and the window guard fixedly secured thereto cannot be moved from the installed position.

6. The window guard anchor assembly of claim 3 wherein said column means includes a pair of relatively hollow, substantially vertical, support members, one of which is operably disposed on each side of said window to be protected for operatively, fixedly positioning said window guard over the window to be protected and at a predetermined fixed and invariable distance therefrom, said vertical support members each including upper and lower end portions, means for fixedly anchoring the lower end portion within the ground and means for operatively securing the upper end portion of each of said vertical support members to a roof overhang.

7. The window guard anchor assembly of claim 6 wherein said column means further includes cable means and means for operatively suspending said cable means substantially through said hollow vertical support member for rendering it virtually impossible to cut therethrough for removing said window guard.

8. The window guard anchor assembly of claim 6 wherein said window guard includes a plurality of substantially hollow tube-like members connected to form a grid adapted to be positioned adjacent to and spaced from a window to be protected for limiting access through said window, each of said substantially hollow tube-like members including cable means suspended within to prevent cutting therethrough.

9. The window guard anchor assembly of claim 6 wherein said mobile home includes a mobile home foundation support means and said column means further includes means for fixedly securing a portion of each of said vertical support members between said lower end portion fixedly anchored underground and the portion of said vertical support member to which said window guard is attached for fixedly anchoring said vertical support member thereto for further resisting removal and preventing the window guard from being pulled away from the window.

10. The window guard anchor assembly of claim 3 wherein said column means includes a pair of elongated, substantially vertical support members, each of which includes a bottom portion and a top portion, means for fixedly anchoring the bottom portion underground to prevent access thereto and means for fixedly securing the top end portion to a roof overhang.

11. The window guard anchor assembly of claim 10 wherein said means for fixedly securing said top end portion to said roof overhang includes retainer means for anchoring one end of a tie-down cable means during high winds, severe storms, hurricanes, tornadoes, and the like.

12. The window guard anchor assembly of claim 10 wherein each of said substantially elongated vertical support members is substantially hollow and further including cable means resistant to cutting operatively disposed within the hollow interior of each of said vertical support members to prevent the cutting thereof.

13. The window guard anchor assembly of claim 10 wherein said means for operatively securing the top portion to the roof overhang includes anchoring means operatively disposed within the interior of said roof overhang for securing the top end of said cables thereto, said means for fixedly anchoring the bottom end portion of said vertical support member including means for fixedly anchoring the opposite end of said cable means under ground.

14. The window guard anchor assembly of claim 10 wherein said window guard includes a plurality of generally horizontal and vertical, substantially hollow tube-like bars operatively connected to form a grid whose bars are positioned close enough together to prevent any intruder and the like from gaining access to the window protected thereby, opposite sides of said grid being fixedly secured to opposite ones of said pair of vertical support members for anchoring the window guard a predetermined distance from the window said distance being such that no intruder or the like can squeeze therebetween to gain access through the protective window, and further including cable means operatively passing through each of the horizontal and vertical tube-like bars of said grid to prevent cutting of said bars.

15. An anchoring apparatus for a window guard grill comprising, in combination:

a pair of elongated vertical support members operably disposed on each side of a window to be protected and spaced a predetermined distance away from and substantially parallel to an outer wall, each of said pair of vertical support members including an upper end portion and a lower end portion;

means for fixedly anchoring the lower end portion of each of said pair of vertical support members underground for preventing easy access thereto;

means for fixedly securing the top end portion of said pair of said vertical support members to a roof overhang;

said window guard grill including a plurality of substantially vertical and horizontally oriented bars spaced such that a person cannot gain access to the window therethrough;

means for fixedly securing the opposite sides of said window guard grill to corresponding ones of said pair of elongated vertical support members for fixedly positioning said window guard grill over said window to be protected and a predetermined fixed distance from said window and substantially parallel thereto, said distance being such that a person cannot squeeze between the window guard grill and the wall to gain access to said window.

16. The anchoring apparatus of claim 15 further including:

inner plate means having an inner plate operably disposed for compressably engaging an inner wall of said mobile home for distributing an outwardly directed axial load over said wall;

outer plate means having an outer plate operably disposed for compressively contacting an outer wall of said mobile home for distributing an inwardly directed axial load over said wall; and connector means operatively coupled to said inner plate means and said outer plate means for sandwiching said wall between said inner plate and said outer plate, said connector means being removable only from inside of said mobile home.

17. The anchoring apparatus of claim 18 further including abutment plates and wherein the upper and lower end portions of said vertical support members are fixedly, operatively secured to said abutment plates and the lower end portion of said vertical support members are cemented into the ground for anchoring same.

18. The anchoring apparatus of claim 15 wherein each of said vertical support means is substantially hollow and has a first cross sectional area, a cable means having a second cross sectional area where said second cross sectional is less than said first cross sectional area, first cable means being operably disposed throughout the length of each of said vertical support members to prevent said vertical support members from being cut and the like.

19. The anchoring apparatus of claim 18 wherein each of said vertical and horizontal bars of said window guard grill include a substantially hollow interior and cable means operably disposed within each of said hollow interiors so as to render it extremely difficult to cut through said bars.

* * * * *